US010480786B2

(12) United States Patent
Hiura

(10) Patent No.: US 10,480,786 B2
(45) Date of Patent: Nov. 19, 2019

(54) HEATER AND GLOW PLUG INCLUDING THE SAME

(71) Applicant: KYOCERA Corporation, Kyoto-shi, Kyoto (JP)

(72) Inventor: Norimitsu Hiura, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 14/411,195

(22) PCT Filed: Jun. 27, 2013

(86) PCT No.: PCT/JP2013/067603
§ 371 (c)(1),
(2) Date: Dec. 24, 2014

(87) PCT Pub. No.: WO2014/003093
PCT Pub. Date: Jan. 3, 2014

(65) Prior Publication Data

US 2015/0167975 A1 Jun. 18, 2015

(30) Foreign Application Priority Data

Jun. 29, 2012 (JP) ..... 2012-147094

(51) Int. Cl.
*F23Q 7/00* (2006.01)
*H05B 3/48* (2006.01)
(Continued)

(52) U.S. Cl.
CPC ..... *F23Q 7/001* (2013.01); *H05B 3/12* (2013.01); *H05B 3/141* (2013.01); *H05B 3/48* (2013.01);
(Continued)

(58) Field of Classification Search
CPC .... H05B 3/12; H05B 3/141; H05B 2203/027; H05B 3/48; H05B 3/148; H05B 2203/018;
(Continued)

(56) References Cited

U.S. PATENT DOCUMENTS 4,633,064 A * 12/1986 Atsumi ..... C04B 37/001 123/145 A
4,634,837 A * 1/1987 Ito ..... C04B 35/58092 123/145 A
(Continued)

FOREIGN PATENT DOCUMENTS

JP 7-282959 A 10/1995
JP 2002-334768 A 11/2002
(Continued)

OTHER PUBLICATIONS

Observation filed by a Third Party, European Patent Application No. 13808581.6, Feb. 17, 2016, 9 pgs.
(Continued)

*Primary Examiner* — Tu B Hoang
*Assistant Examiner* — Masahiko Muranami
(74) *Attorney, Agent, or Firm* — Volpe and Koenig, P.C.

(57) ABSTRACT

A heater of this invention includes an insulating base made of a ceramic, a resistor buried in the insulating base, and leads connected to end portions of the resistor, in which both the resistor and the leads contain electrical conductors and insulating ceramic particles dispersed in the electrical conductors and the insulating ceramic particles contained in the resistor are smaller than the insulating ceramic particles contained in the leads.

7 Claims, 2 Drawing Sheets

(51) Int. Cl.
*H05B 3/14* (2006.01)
*H05B 3/12* (2006.01)

(52) U.S. Cl.
CPC .. *H05B 2203/016* (2013.01); *H05B 2203/027* (2013.01)

(58) Field of Classification Search
CPC ..... H05B 3/10; F23Q 7/001; C22C 45/10; C22C 47/14; C04B 35/76; C04B 35/482; C04B 2235/3427; C04B 35/584; C04B 35/583; H01B 1/06; H01B 1/08; H01B 1/14; H01B 1/18; H01B 1/16
USPC ..... 219/541, 260, 538, 270, 544, 553, 267, 219/505, 548; 501/96.1, 97.1, 98.6; 252/512, 516
See application file for complete search history.

(56) References Cited

U.S. PATENT DOCUMENTS 4,814,581 A * 3/1989 Nunogaki ..... F23Q 7/001 219/270
4,845,061 A * 7/1989 Inoguchi ..... C04B 35/111 501/97.2
4,869,943 A * 9/1989 Corbin ..... C04B 35/591 428/114
5,206,484 A * 4/1993 Issartel ..... F23Q 7/001 123/145 A
5,304,778 A * 4/1994 Dasgupta ..... F23Q 7/001 123/145 A
5,603,877 A * 2/1997 Kato ..... C04B 35/584 501/95.3
5,750,958 A * 5/1998 Okuda ..... H01C 7/003 123/145 A
5,998,049 A * 12/1999 Tanaka ..... C22C 29/00 219/541
6,391,811 B1 * 5/2002 Hebsur ..... C04B 35/58092 501/95.3
6,563,089 B2 * 5/2003 Watanabe ..... C04B 35/5626 123/145 A
6,924,464 B2 * 8/2005 Zhou ..... H05B 3/143 118/724
7,223,942 B2 5/2007 Konishi et al.
7,247,819 B2 * 7/2007 Goto ..... H01L 21/67103 219/444.1
7,612,006 B2 * 11/2009 Komeya ..... B82Y 30/00 252/506
2002/0162830 A1 * 11/2002 Taniguchi ..... F23Q 7/001 219/270
2005/0274707 A1 12/2005 Matsubara et al.
2006/0011602 A1 * 1/2006 Konishi ..... F23Q 7/00 219/270
2008/0206561 A1 * 8/2008 Yokoyama ..... C01G 29/006 428/402
2009/0320782 A1 * 12/2009 Hiura ..... F23Q 7/001 123/145 A
2010/0213188 A1 * 8/2010 Nishihara ..... F23Q 7/001 219/544
2010/0267543 A1 * 10/2010 Becher ..... C04B 35/593 501/97.1
2011/0114622 A1 * 5/2011 Sekiguchi ..... F23Q 7/001 219/270
2012/0145695 A1 * 6/2012 Radmacher ..... B28B 1/008 219/270
2013/0146579 A1 6/2013 Hiura
2013/0284714 A1 10/2013 Okamura et al.

FOREIGN PATENT DOCUMENTS

JP 2006-049279 A 2/2006
JP 2006-127995 A 5/2006
JP 2006127995 A † 5/2006
JP 2010-210134 A 9/2010
JP 2010210134 A † 9/2010
JP 2010-277706 A 12/2010
JP 2010277706 A † 12/2010
WO 03/092330 A1 11/2003
WO 2012/014872 A1 2/2012
WO 2012/057213 A1 5/2012

OTHER PUBLICATIONS

Excerpt from Sympatec Image Analysis: Overview of Particle Size and Shape . . . , "Fundamentals Particle Size and Shape Calculation by Image Analysis," https://www.sympatec.com/EN/ImageAnalysis/Fundamentals.html, 5 pgs.
Japanese Office Action (Written Opposition) with English concise explanation, Japanese Patent No. 5777812, dated Mar. 7, 2016, 19 pgs.
European Office Action, European Patent Application No. 13808581.6, dated May 20, 2016, 5 pgs.
International Search Report, PCT/JP2013/067603, dated Jul. 16, 2013, 1 pg.

* cited by examiner
† cited by third party (a)

(b)

HEATER AND GLOW PLUG INCLUDING THE SAME

TECHNICAL FIELD

The present invention relates to a heater for use in, for example, a heater for ignition or flame detection in a combustion type in-vehicle heating device, a heater for ignition of various combustion appliances, such as an oil fan heater, a heater for a glow plug of an automobile engine, a heater for various sensors, such as an oxygen sensor, a heater for heating a measuring device, or the like. The present invention also relates to a glow plug having the heater described above.

BACKGROUND ART

The heater for use in a glow plug of an automobile engine or the like contains a resistor having a heat-generating portion, a lead, and an insulating base. Materials of the lead and the resistor are selected and shapes of the lead and the resistor are determined so that the resistance of the lead is smaller than the resistance of the resistor (for example, refer to PTL 1).

In recent years, such heaters tend to be used more frequently in a high-temperature environment than before. Therefore, there is a possibility that thermal stress generated in the heater exerts a larger effect than before during a heat cycle.

CITATION LIST

Patent Literature

PTL 1: Japanese Unexamined Patent Application Publication No. 2002-334768

SUMMARY OF INVENTION

A heater of the present invention has an insulating base made of a ceramic, a resistor buried in the insulating base, and leads connected to end portions of the resistor, in which both the resistor and the leads contain electrical conductors and ceramic particles dispersed in the electrical conductors, and the insulating ceramic particles contained in the resistor are smaller than the insulating ceramic particles contained in the leads.

The present invention also relates to a glow plug having the heater with the configuration described above and a metal holding member which is electrically connected to the leads and holds the heater.

DESCRIPTION OF EMBODIMENTS

Figure 1:
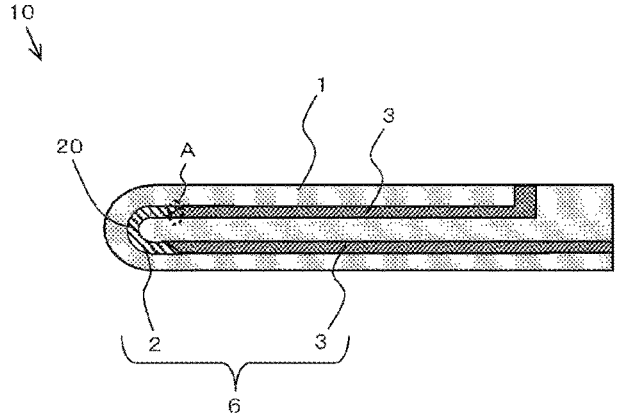
FIG. 1(*a*) is a schematic longitudinal cross-sectional view illustrating one example of an embodiment of a heater of the present invention, and FIG. 1(*b*) is an enlarged view of a region A that is a principal portion illustrated in FIG. 1(*a*).
Figure 1:
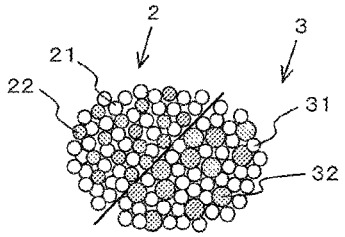

Hereinafter, an example of an embodiment of a heater 10 of the present invention is described in detail with reference to the drawings.

The heater 10 of this embodiment has an insulating base 1 made of a ceramic, a resistor 2 buried in the insulating base 1, and leads 3 connected to end portions of the resistor 2. Both the resistor 2 and the leads 3 contain electrical conductors 21 and 31 and insulating ceramic particles (hereinafter also referred to as ceramic particles) 22 and 32. The ceramic particles 22 contained in the resistor 2 are smaller than the ceramic particles 32 contained in the leads 3.

The insulating base 1 in the heater 10 of this embodiment has a rod shape, for example. The insulating base 1 covers a conductor line 6 (the resistor 2 and the leads 3). In other words, the conductor line 6 (resistor 2 and leads 3) is buried in the insulating base 1. Herein, the insulating base 1 is formed of a ceramic. Thus, the heat resistance of the insulating base 1 can be increased. As a result, the reliability of the heater 10 in a high-temperature environment improves. Specifically, examples of the ceramic used in the insulating base 1 include ceramics having electrical insulation properties, such as oxide ceramics, nitride ceramics, or carbide ceramics. In the heater 10 of this embodiment, the insulating base 1 contains a silicon nitride ceramic, which has good strength, toughness, insulation properties, and heat resistance. The silicon nitride ceramic can be obtained by the following method. For example, 3 to 12% by mass of a rare earth element oxide, such as $Y_2O_3$, $Yb_2O_3$, or $Er_2O_3$, as a sintering aid and 0.5 to 3% by mass of $Al_2O_3$ and $SiO_2$ are mixed with silicon nitride as the main component. In this process, $SiO_2$ is added in such a manner that the amount of the $SiO_2$ contained in a sintered compact is 1.5 to 5% by mass. Then, the obtained mixture is molded into a predetermined shape. Thereafter, the resultant mixture is subjected to hot-press firing at 1650 to 1780° C., for example, so that a silicon nitride ceramic can be obtained.

In this embodiment, $MoSi_2$, $WSi_2$, or the like is dispersed in the insulating base 1 made of the silicon nitride ceramic. In this case, the coefficient of thermal expansion of the insulating base 1 made of the silicon nitride ceramic as the base material can be brought close to the coefficient of thermal expansion of the conductor line 6 containing Mo, W, or the like. Thus, the thermal stress generated between the insulating base 1 and the conductor line 6 can be reduced. As a result, the durability of the heater 10 can be increased.

The resistor 2 is buried in the insulating base 1. The resistor 2 has a heat-generating portion 20 which is a region that mainly generates heat. When the resistor 2 has a folded shape as illustrated in FIG. 1(*a*), a portion near the midpoint of the folded portion generates the most heat. In this case, the portion near the midpoint of the folded portion serves as the heat-generating portion 20.

The resistor 2 contains a metal, such as W, Mo, or Ti, or a carbide, nitride, or silicide of the metal as the main component. The main component serves as the electrical conductors 21 described above. The electrical conductors 21 may have a particle shape as illustrated in FIG. 1(*b*), but the shape is not limited thereto. The electrical conductors 21 may have a scale shape, a needle shape, or the like, for example.

In the heater 10 of this embodiment, the electrical conductors 21 of the resistor 2 contain tungsten carbide (WC). This is because a difference in the coefficient of thermal expansion between the silicon nitride ceramic constituting the insulating base 1 and the WC constituting the resistor 2 is small. WC is good as the material of the resistor 2 with respect to having high heat resistance. Furthermore, in the resistor 2, the WC is contained as the main component, and 20% by mass or more of silicon nitride is added to the WC in this embodiment. This silicon nitride constitutes the ceramic particles 22 described above. In the insulating base 1 made of the silicon nitride ceramic, the electrical conductors 21 serving as the resistor 2 have a coefficient of thermal expansion larger than that of the silicon nitride. Therefore, thermal stress is applied between the insulating base 1 and the resistor 2 during a heat cycle. Then, the coefficient of thermal expansion of the resistor 2 is brought close to the coefficient of thermal expansion of the insulating base 1 by adding the silicon nitride as the ceramic particles 22 into the resistor 2. Thus, the thermal stress generated between the insulating base 1 and the resistor 2 during temperature increase and temperature decrease of the heater 10 can be reduced.

Moreover, when the content of the silicon nitride contained in the resistor 2 is 40% by mass or less, variations in the resistance of the resistor 2 can be decreased, and therefore the resistance can be easily adjusted.

Accordingly, in the heater 10 of this embodiment, the content of the silicon nitride contained in the resistor 2 is 20 to 40% by mass. As an additive to be added to the resistor 2, 4 to 12% by mass of boron nitride can be added in place of the silicon nitride.

In the heater 10 of this embodiment, the thickness of the resistor 2 is 0.5 to 1.5 mm. The width of the resistor 2 is 0.3 to 1.3 mm. By setting the thickness and the width of the resistor 2 within these ranges, the resistance of the resistor 2 can be increased. This enables the resistor 2 to generate heat efficiently.

The leads 3 connected to the end portions of the resistor 2 contain a metal, such as W, Mo, or Ti, or a carbide, nitride, or silicide of the metal as the main component. The main component constitutes the electrical conductors 31 described above. For the leads 3, the same material as that of the resistor 2 can be used. In the heater 10 of this embodiment, the leads 3 contain WC as the electrical conductors 31. This is because a difference in the coefficient of thermal expansion between the silicon nitride ceramic constituting the insulating base 1 and the WC is small. Furthermore, in this embodiment, the leads 3 contain WC as the main component, and 15% by mass or more of silicon nitride is added to the WC. The silicon nitride constitutes the ceramic particles 32 described above. When the content of the silicon nitride in the leads 3 is further increased, the coefficient of thermal expansion of the leads 3 can be brought closer to the coefficient of thermal expansion of the insulating base 1. Thus, the thermal stress generated between the leads 3 and the insulating base 1 can be reduced. When the content of the silicon nitride is 40% by mass or less, variations in the resistance of the leads 3 can be decreased, and therefore the resistance can be easily adjusted. Therefore, in the heater 10 of this embodiment, the content of the silicon nitride contained in the leads 3 is 15 to 40% by mass.

In the heater 10 of this embodiment, the cross-sectional area in a direction vertical to the direction in which a current flows in the leads 3 is larger than the cross-sectional area in a direction vertical to the direction in which a current flows in the resistor 2. Specifically, the cross-sectional area of the leads 3 is about 2 to 5 times the cross-sectional area of the resistor 2. Thus, the resistance of the leads 3 can be made smaller than the resistance of the resistor 2. In other words, the resistance of the resistor 2 is made larger than the resistance of the leads 3. Thus, the heater 10 is designed to generate heat in the resistor 2. Specifically, in the heater 10 of this embodiment, the thickness of the leads 3 is 1 to 2.5 mm. In the heater 10 of this embodiment, the width of the leads 3 is 0.5 to 1.5 mm.

By reducing the content of the ceramic particles 32 in the leads 3 to be less than the content of the ceramic particles 22 in the resistor 2, the resistance of the leads 3 may be made less than the resistance of the resistor 2.

Herein, the conductor line 6 (resistor 2 and leads 3) contains the electrical conductors 21 and 31 and the ceramic particles 22 and 32. The ceramic particles 22 contained in the resistor 2 are smaller than the ceramic particles 32 contained in the leads 3. Thus, the level of the thermal stress generated between the resistor 2 and the insulating base 1 and the level of the thermal stress generated between the leads 3 and the insulating base 1 can be brought close to each other during a heat cycle. As a result, concentration, in a specific portion, of the thermal stress generated inside the heater 10 can be reduced.

Specifically, due to the fact that the ceramic particles 22 contained in the resistor 2 are small, the specific surface area of the ceramic particles 22 contained in the resistor 2 increases. Due to the fact that the ceramic particles 22 with a large specific surface area are dispersed in the electrical conductors 21, the resistor 2 is relatively difficult to thermally expand. On the other hand, due to the fact that the ceramic particles 32 contained in the leads 3 are large, the specific surface area of the ceramic particles 32 contained in the leads 3 is decreased. Due to the fact that the ceramic particles 32 with a small specific surface area are dispersed in the electrical conductors 31, the leads 3 thermally expand relatively easily. When focusing on the temperature distribution of the heater 10 when using the heater 10, while the temperature of the resistor 2 which generates heat becomes relatively high, the temperature of the leads 3 becomes relatively low. More specifically, due to the fact that the ceramic particles 22 contained in the resistor 2 are smaller than the ceramic particles 32 contained in the leads 3, the resistor 2, whose temperature becomes relatively high, can be made difficult to thermally expand and also the leads 3, whose temperature becomes relatively low, can be made easy to thermally expand. Thus, when using the heater 10, a difference between the thermal stress generated between the resistor 2 and the insulating base 1 and the thermal stress generated between the leads 3 and the insulating base 1 can be decreased.

Herein, the average particle diameter of the ceramic particles 32 contained in the leads 3 is 0.1 to 15 μm. The average particle diameter of the ceramic particles 22 contained in the resistor 2 is 20% or more and 90% or less and preferably 50% or more and 70% or less of the average particle diameter of the ceramic particles contained in the leads 3.

The average particle diameter of these ceramic particles 22 and 32 may be measured as follows. The heater 10 is cut at an arbitrary place where the resistor 2 or the leads 3 are buried, and then the cross-sectional portion is observed under a scanning electron microscope (SEM) or a metallurgical microscope. Five arbitrary straight lines are drawn in the obtained image, and the average length of 50 particles crossed by the straight lines can be defined as the average particle diameter. This method for determining the average particle diameter is also referred to as the chord method. The average particle diameter can also be determined with an image-analysis device, LUZEX-FS, manufactured by Nireco Corporation, in place of the chord method described above.

In the heater 10 of this embodiment, the ceramic particles 22 and 32 constituting the conductor line 6 (resistor 2 and leads 3) contain the same ceramic material as that used to form the insulating base 1. Thus, when the temperature of the conductor line 6 (resistor 2 and leads 3) increases, the thermal stress generated between the conductor line 6 and the insulating base 1 can be decreased. This can reduce the occurrence of microcracks in the interface between the conductor line 6 and the insulating base 1. The fact that the ceramic particles 22 and 32 are formed of the same ceramic as that forming the insulating base 1 does not always mean that the ceramic particles 22 and 32 contain completely the same ceramic as that of the insulating base 1. Specifically, the case where the main component of the ceramic particles 22 and 32 and the main component of the insulating base 1 contain the same ceramic is also included. For example, a case is mentioned where when the insulating base 1 is one in which silicon nitride is contained as the main component and a sintering aid component is contained therein, the ceramic particles 22 and 32 contain silicon nitride.

Figure 2:
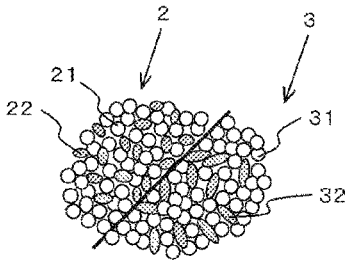
FIG. 2 is an enlarged cross-sectional view of a principal portion illustrating another example of the embodiment of the heater of the present invention.

In another example of this embodiment, both the ceramic particles 22 and 32 contained in the resistor 2 and the leads 3 are needle-shaped particles, as illustrated in FIG. 2. In this case, the length of the major axis of the ceramic particles 22 contained in the resistor 2 is shorter than the length of the major axis of the ceramic particles 32 contained in the leads 3.

Specifically, in another example of the embodiment of the present invention, when the ceramic particles 32 contained in the leads 3 are observed by the chord method described above, the average aspect ratio (major axis length/minor axis length) of the particles crossing the straight lines is 1.5 to 10 and the average major axis length is 0.1 to 15 μm, for example. In this case, when the ceramic particles 22 contained in the resistor 2 are observed by the chord method described above, the average aspect ratio (major axis length/minor axis length) of the particles crossing the straight lines is smaller than the average aspect ratio of the ceramic particles 32 contained in the leads 3. The average major axis length of the ceramic particles 22 contained in the resistor 2 is 90% or less of the average major axis length of the ceramic particles 32 contained in the leads 3.

Due to the fact that both the ceramic particles 22 and 32 contained in the resistor 2 and the leads 3 are needle-shaped particles, the ceramic particles 22 and the ceramic particles 32 are entangled with each other, thus improving the strength of the heater 10. As a result, the possibility of breakage due to an external force occurring in the heater 10 can be reduced.

The present invention is not limited to the case where both the ceramic particles 22 and 32 contained in the resistor 2 and the leads 3 are needle-shaped particles. The ceramic particles 32 contained in the leads 3 may be needle-shaped particles and the ceramic particles 22 contained in the resistor 2 may be particles having a shape other than the needle shape. Alternatively, the ceramic particles 22 contained in the resistor 2 may be needle-shaped particles and the ceramic particles 32 contained in the leads 3 may be particles having a shape other than the needle shape. In such a case, the major axis length of the needle-shaped particles is compared with the length (diameter) of the particles having a shape other than the needle shape, and then the size of the particles is evaluated.

Figure 3:
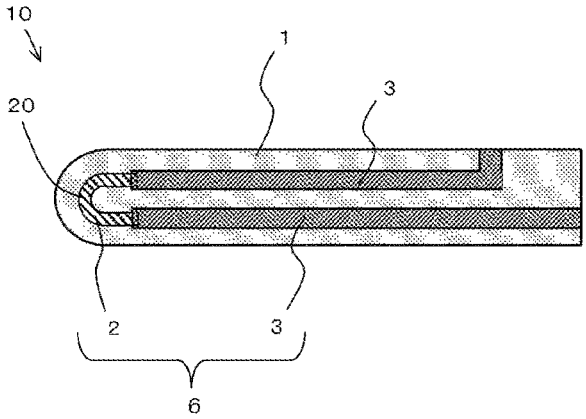
FIG. 3 is a schematic longitudinal cross-sectional view illustrating another example of the embodiment of the heater of the present invention.

As illustrated in FIG. 3, the leads 3 may be connected to the end portions of the resistor 2 in such a manner as to wrap the end portions of the resistor 2. Although there is a tendency for thermal stress to be concentrated at the end portions of the resistor 2, the thermal stress generated between the resistor 2 and the insulating base 1 can be reduced by wrapping the portions with the leads 3. This makes it difficult for microcracks to form between the ceramic particles 22 and the electrical conductors 21 of a top layer portion of the resistor 2. As a result, changes in the resistance of the resistor 2 can be reduced.

Figure 4:
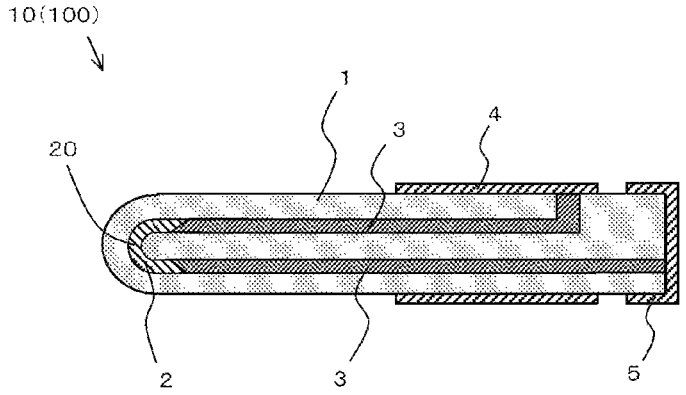
FIG. 4 is a schematic longitudinal cross-sectional view illustrating an example of an embodiment of a glow plug of the present invention.

The heater 10 of this embodiment can be used as a glow plug 100 having a metal holding member 4 which is electrically connected to the lead 3 and holds the heater 10, as illustrated in FIG. 4. Specifically, in the glow plug 100 of this example, the metal holding member 4 (sheath metal fitting) is electrically connected to one of the leads 3. An electrode 5 is electrically connected to the other one of the leads 3. As the electrode 5, a cap type electrode or the like can be used. As another example of the electrode 5, a wire or the like can be used, for example.

The metal holding member 4 (sheath metal fitting) is a metal cylindrical body holding the heater 10. The metal holding member 4 is joined to one of the leads 3 drawn out to the side surface of the insulating base 1 with a wax material or the like. The electrode 5 is joined to the other one of the leads 3 drawn out to the back end of the insulating base 1 with a wax material or the like. Due to the fact that the glow plug 100 of this example has the heater 10 in which a difference between the thermal stress generated between the resistor 2 and the insulating base 1 and the thermal stress generated between the leads 3 and the insulating base 1 is reduced, the durability is improved.

Next, a method for manufacturing the heater 10 of this embodiment is described.

The heater 10 of this embodiment can be molded by an injection molding method or the like, for example.

First, as the material of the electrical conductors 21 and 31, a conductive ceramic powder, such as WC, $WSi_2$, $MoSi_2$, or SiC, is prepared. As the material of the ceramic particles 22 and 32, an insulating ceramic powder, such as $Si_3N_4$, $Al_2O_3$, $ZrO_2$, or AlN, is prepared. Then, a conductive paste to be formed into the resistor 2 or the leads 3 is produced using the conductive ceramic powder. Next, the insulating ceramic powder is dispersed in the conductive paste. In this process, as the insulating ceramic powder added to the conductive paste to be formed into the resistor 2, one having a particle diameter smaller than that of the insulating ceramic powder added to the conductive paste to be formed into the leads 3 is used. Separately, a ceramic paste to be formed into the insulating base 1 containing the insulating ceramic powder, a resin binder, and the like, is produced.

Next, a molded body (molded body a) of the conductive paste having a predetermined pattern to be formed into the resistor 2 is molded using the conductive paste by an injection molding method or the like. Then, the conductive paste is charged into a die in a state where the molded body a is held in the die, and then another molded body (molded body b) of the conductive paste having a predetermined pattern to be formed into the leads 3 is molded. Thus, the molded body a and the molded body b connected to the molded body a are held in the die.

Next, in the state where the molded body a and the molded body b are held in the die, the die is partially exchanged with one for molding the insulating base 1. Then, the ceramic paste to be formed into the insulating base 1 is charged into the die. Thus, a molded body (molded body d) of the heater 10 in which the molded body a and the molded body b are covered with another molded body (molded body c) of the ceramic paste is obtained.

Next, the obtained molded body d is fired at a temperature of 1650 to 1780° C. and at a pressure of 30 to 50 MPa, so that the heater 10 can be manufactured. It is desirable to perform the firing in a non-oxidizing gas atmosphere, such as hydrogen gas.

EXAMPLES

Examples of the heater 10 of the present invention are described. Two samples using the manufacturing method described above were produced as samples 2 and 3. Furthermore, a sample 1 was produced as a comparative example. Specifically, in the samples 1 to 3, the insulating base 1 contains silicon nitride as the main component and the resistor 2 and the leads 3 contain WC as the main component. In the samples 1 to 3, silicon nitride is dispersed as the insulating ceramic particles 22 and 32 in the resistor 2 and the leads 3. The particle diameter of the dispersed insulating ceramic particles 22 and 32 is as follows. In the sample 1, the insulating ceramic particles 22 with an average particle diameter of 10 μm were dispersed in the resistor 2 and the insulating ceramic particles 32 with an average particle diameter of 8 μm were dispersed in the leads 3. In the sample 2, the insulating ceramic particles 22 with an average particle diameter of 6 μm were dispersed in the resistor 2 and the insulating ceramic particles 32 with an average particle diameter of 8 μm were dispersed in the leads 3. In the sample 3, the insulating ceramic particles 22 with an average particle diameter of 4 μm were dispersed in the resistor 2 and the insulating ceramic particles 32 with an average particle diameter of 8 μm were dispersed in the leads 3.

The outer circumferential shape of the cross section of the insulating base 1 is a circular shape. The outer circumferential shape of the cross section of the resistor 2 and the leads 3 is an oval shape. The diameter of the insulating base 1 was 3.5 mm, the thickness of the resistor 2 and the leads 3 was 1.3 mm, and the width thereof was 0.6 mm.

A cycle test was performed using these heaters 10. The conditions of the cycle test are as follows. First, energization for 5 minutes is performed in the heater 10 in such a manner that the temperature of the resistor 2 reaches 1400° C., and thereafter, the energization is stopped and the heaters are allowed to stand for 2 minutes. A heat cycle test is performed in which the processes described above as one cycle were repeated for 10,000 cycles. The results are shown in Table 1.

TABLE 1

| Sample No. | Resistor Diameter of ceramic particles (μm) | Leads Diameter of ceramic particles (μm) | Resistor change (%) | Cracks |
|---|---|---|---|---|
| 1 | 10 | 8 | 40 | Occurred |
| 2 | 6 | 8 | 1 | Not observed |
| 3 | 4 | 8 | 0.2 | Not observed |

When changes in the resistance of the heaters 10 before and after the heat cycle test were measured, the resistance change of the samples (samples 2 and 3) of the Example of the present invention was 1% or less. Moreover, when the resistor 2 and the leads 3 were observed, no generation of microcracks was observed in the resistor 2, the leads 3, or the connection portion thereof. On the other hand, the resistance change of the sample (sample 1) of the comparative example was 40%. Cracks were generated in the connection portion of the resistor 2 and the leads 3. The results above indicated that the thermal stress generated in the heater 10 can be reduced by the use of the configuration of the present invention.

REFERENCE SIGNS LIST

1: Insulating base
2: Resistor
10: Heater
100: Glow plug
20: Heat-generating portion
3: Lead
21, 31: Electrical conductor
22, 32: Insulating ceramic particles
4: Metal holding member
5: Electrode
6: Conductor line

The invention claimed is:

1. A heater, comprising:
an electrically insulating base made of at least one of a ceramic material;
a resistor buried in the electrically insulating base; and
a lead connected to the resistor;
wherein the resistor contains a first set of electrically insulating ceramic particles, and the lead contains a second set of electrically insulating ceramic particles,
wherein an average particle diameter of the first set of electrically insulating ceramic particles is smaller than an average particle diameter of the second set of electrically insulating ceramic particles, and
the first set of electrically insulating ceramic particles and the second set of electrically insulating ceramic particles are both made of the same material as at least one of the ceramic material forming the electrically insulating base.

2. The heater according to claim 1, wherein the first set of electrically insulating ceramic particles and the second set of electrically insulating ceramic particles are formed of non-spherical particles and a length of a major axis of the first set of electrically insulating ceramic particles is shorter than a length of a major axis of the second set of electrically insulating ceramic particles.

3. The heater according to claim 1, wherein the lead is connected to an end portion of the resistor in such a manner as to wrap the end portion of the resistor.

4. A glow plug, comprising:
the heater according to claim 1; and
a metal holding member which is electrically connected to the lead and holds the heater.

5. The heater according to claim 1, wherein the average particle diameter of the first set of electrically insulating ceramic particles is between 20% and 90% of the average particle diameter of the second set of electrically insulating ceramic particles.

6. The heater according to claim 1, wherein the average particle diameter of the first set of electrically insulating ceramic particles is between 50% and 70% of the average particle diameter of the second set of electrically insulating ceramic particles.

7. The heater according to claim 1, wherein the resistor contains a first set of electrical conductors mixed with the first set of electrically insulating ceramic particles, and the leads contain a second set of electrical conductors mixed with the second set of electrically insulating ceramic particles.

* * * * *